US006367103B1

(12) United States Patent
Collins

(10) Patent No.: US 6,367,103 B1
(45) Date of Patent: Apr. 9, 2002

(54) INVALID HOISTS

(75) Inventor: Nicholas Collins, Stonehouse (GB)

(73) Assignee: Arjo Limited (GB)

( * ) Notice: Subject to any disclaimer, the term of this patent is extended or adjusted under 35 U.S.C. 154(b) by 0 days.

(21) Appl. No.: 09/672,745

(22) Filed: Sep. 28, 2000

(30) Foreign Application Priority Data

Oct. 19, 1999 (GB) ..... 9924543

(51) Int. Cl.[7] ..... A61G 7/12
(52) U.S. Cl. ..... 5/86.1; 5/83.1; 5/87.1
(58) Field of Search ..... 5/81.1 R, 83.1, 5/86.1, 87.1

(56) References Cited

U.S. PATENT DOCUMENTS

| | | | | |
|---|---|---|---|---|
| 3,694,829 A | * 10/1972 | Bakker | 5/86.1 |
| 4,712,257 A | * 12/1987 | James | 5/83.1 |
| 4,918,771 A | * 4/1990 | James | 5/87.1 |
| 5,022,106 A | * 6/1991 | Richards | 5/86.1 |
| 5,649,329 A | * 7/1997 | Horcher et al. | 5/83.1 |
| 5,987,664 A | * 11/1999 | Somerton et al. | 5/87.1 |

FOREIGN PATENT DOCUMENTS

| | | |
|---|---|---|
| EP | 424344 A | 4/1991 |
| EP | 715841 A | 6/1996 |
| GB | 2184706 A | 7/1987 |
| GB | 2327931 A | 2/1999 |
| GB | 2327931 A | 10/1999 |

* cited by examiner

*Primary Examiner*—Michael F. Trettel
(74) *Attorney, Agent, or Firm*—Roberts, Mlotkowski & Hobbes

(57) ABSTRACT

An invalid hoist comprises a lifting arm, a sling hanger support angularly displaceable relative to the lifting arm about a vertical or substantially vertical axis and a sling hanger which is of unitary construction pivotable about a horizontal axis relative to the sling hanger support and which presents two spaced sling attachment points on one side of the horizontal axis and at least one sling attachment point on the other side of the horizontal axis. A rotary drive mechanism is provided for pivoting the sling hanger about said horizontal axis relative to the sling hanger support and switch means are provided for selectively rotating the rotary drive means in one or other of two opposite directions. The sling hanger support is of generally inverted U-shape configuration having a cross member and two parallel or substantially parallel limbs depending from the cross member. The sling hanger is pivotably connected to the lower ends of the depending limbs and the rotary drive mechanism comprises a power unit supported by the sling hanger support at or adjacent to the cross member and a transmission system connecting the power unit to the sling hanger for pivoting the sling hanger relative to the sling hanger support.

10 Claims, 3 Drawing Sheets

INVALID HOISTS

INTRODUCTION

This invention relates to invalid hoists for use with slings in which invalids are suspended during lifting.

It is known from GB-A-2184706 to provide an invalid hoist with a lifting arm, a sling hanger support which is supported for angular displacement relative to a lifting arm of the hoist about a vertical axis, a sling hanger which is pivotable about a horizontal axis relative to the sling hanger support and which presents spaced sling attachment points on both sides of the horizontal axis, and means for retaining the hanger in alternative angular positions about said horizontal axis. The preferred retaining means, and indeed that used in practice, has been frictional means allowing the hanger to be infinitely adjustable in position throughout an operative range of angular movement. The drawback of this arrangement is that the frictional restraint to movement about said horizontal axis imposes a strain on an attendant, particularly on the wrists of the attendant, and especially when an operating handle of the hanger is in a raised position.

It is known from GB-A-2327931 to replace the frictional restraint with rotary drive means for pivoting the sling hanger about the aforesaid horizontal axis and switch means for selectively rotating the rotary drive means in one or other of two opposite directions. The rotary drive means are provided adjacent to the pivot axis between the sling hanger and the sling hanger support. This suffers from the disadvantage that the rotary drive means are not sealed from ingress of water when the hoist is used in bathing environments.

The present invention seeks to overcome this latter drawback.

SUMMARY OF THE INVENTION

According to the invention there is provided an invalid hoist comprising a lifting arm, a sling hanger support angularly displaceable relative to the lifting arm about a vertical or substantially vertical axis and a sling hanger which is of unitary construction pivotable about a horizontal axis relative to the sling hanger support and which presents two spaced sling attachment points on one side of the horizontal axis and at least one sling attachment point on the other side of the horizontal axis for connection of a first pair of sling attachments to one side of the horizontal axis and for connection of a second pair of sling attachments to the other side of the horizontal axis, rotary drive means for pivoting the sling hanger about said horizontal axis relative to the sling hanger support and switch means for selectively rotating the rotary drive means in one or other of two opposite directions, wherein the sling hanger support is of inverted generally U-shaped configuration having a cross member and two parallel or substantially parallel limbs depending from the cross member, the sling hanger is pivotably connected to the lower ends of the depending limbs and the rotary drive means comprises a power unit supported by the sling hanger support at or adjacent to the cross member and a transmission system connecting the power unit to the sling hanger for pivoting the sling hanger relative to the sling hanger support.

Preferred and/or optional features of the invention are set forth in claims 2 to 12, inclusive.

The invention will now be more particularly described, by way of example, with reference to the accompanying drawings.

DESCRIPTION OF THE PREFERRED EMBODIMENTS

Figure 1:
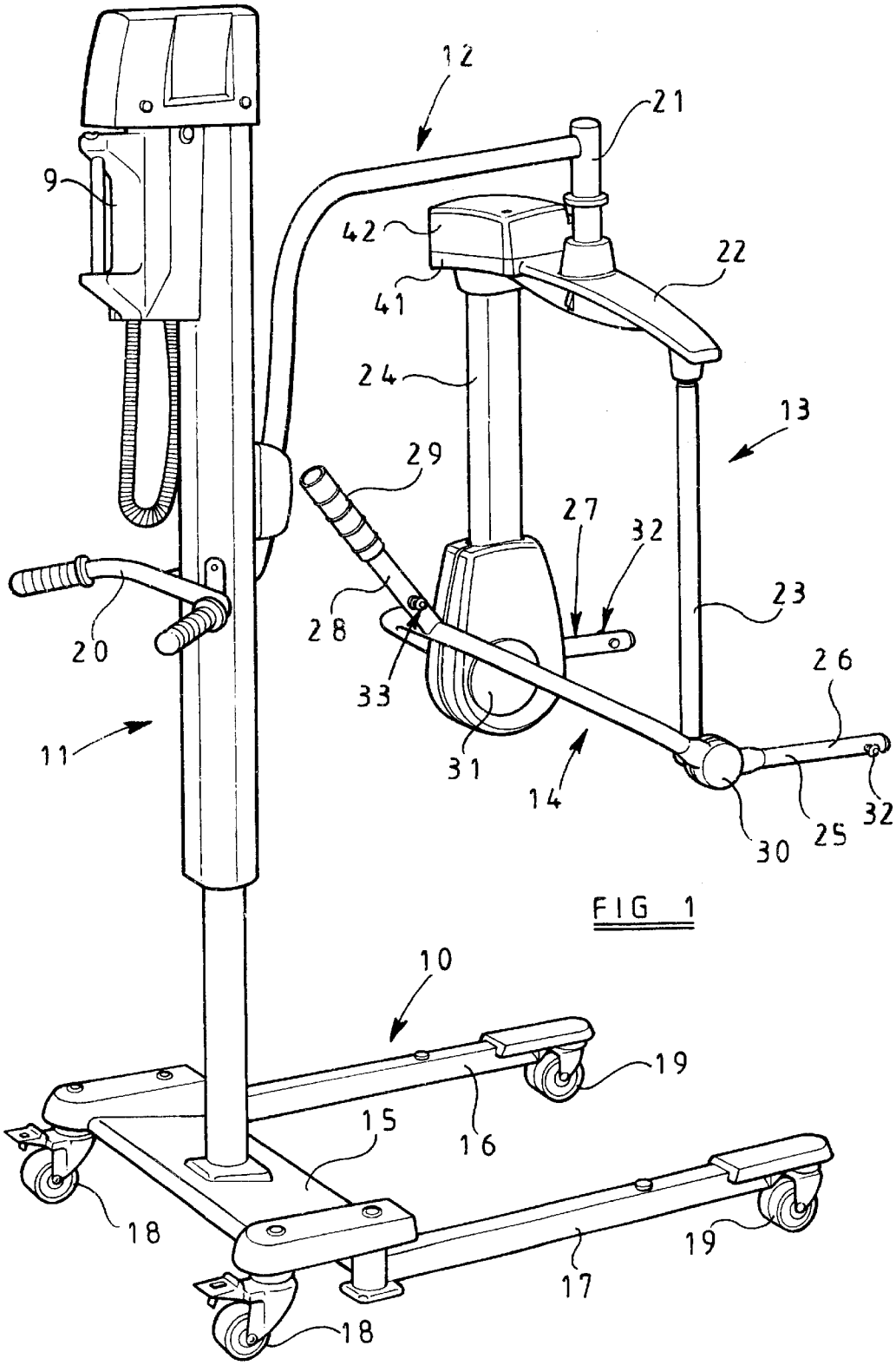
FIG. 1 is a perspective view of one embodiment of an invalid hoist according to the invention.

Referring firstly to FIG. 1 of the drawings, the invalid hoist shown therein comprises a chassis 10, a lifting column 11 upstanding from the chassis 10, a lifting arm 12 projecting from the lifting column 11, a sling hanger support 13 at the free or outer end of the lifting arm 12 and a sling hanger 14 supported by the sling hanger support 13.

The chassis 10, lifting column 11 and lifting arm 12 are now well known.

The chassis comprises a transversely extending part 15 from which the lifting column 11 upstands and two arms 16 and 17 pivotable relative to the part 15 between positions in which they extend parallel to one another and positions in which they are splayed apart at their outer free ends. The part 15 has two castors 18 and a further castor 19 is provided at the free end of each of the arms 16 and 17.

The lifting column 11 includes a motor driven actuator (not shown), such as is described in EP-A-0424344, for raising and lowering the lifting arm 12 relative to the lifting column 11. A rechargeable battery 9 is mounted on the lifting column 11 and powers the motor driven actuator.

A handle 20 is provided on the lifting column 11 whereby an attendant can move the invalid hoist along the floor.

The sling hanger support 13 is in the form of an inverted, generally U-shaped, member which is mounted in a vertical bearing 21 at the free outer end of the lifting arm 12 to turn about a rigid vertical axis.

The sling hanger support 13 has a cross member 22 and two parallel or substantially parallel limbs 23, 24 depending from the cross member 22.

The sling hanger 14 has a generally U-shaped part 25 having two limbs 26 and 27 which are pivotally connected to the lower ends of the limbs 23 and 24, respectively, of the sling hanger support 13 for pivotable movement about a common horizontal axis and a central arm 28 extending from the base of the U-shaped part 25 away from said horizontal axis. A hand grip 29 is provided at the free end of the arm 28.

A simple pivotable connection 30 is provided between the lower end of the limb 23 of the sling hanger support 13 and the limb 26 of the sling hanger 14. However, a rotary drive mechanism 31 is provided for pivoting the limb 27 of the sling hanger 14 relative to the limb 24 of the sling hanger support 13.

Sling attachments 32, in the form of headed studs, are provided at or adjacent to the free ends of the limbs 26 and 27 and two further sling attachments 33, also in the form of headed studs, are provided on opposite sides of the arm 28. The studs 33 could, however, be replaced by a single stud.

Figure 2:
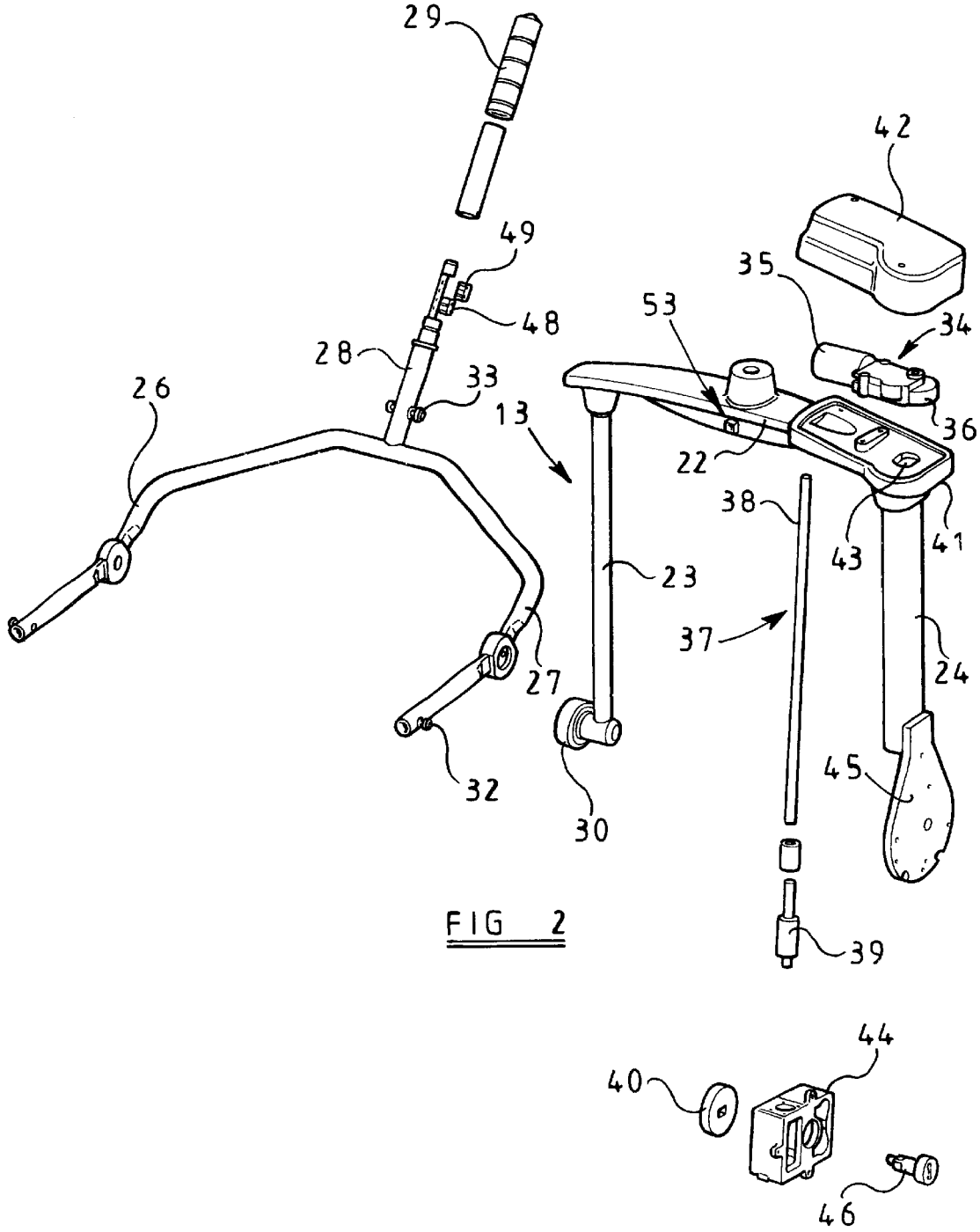
FIG. 2 is an exploded perspective view of the sling hanger and sling hanger support.

Referring now to FIG. 2 of the drawings, the rotary drive mechanism 31 shown therein comprises a power unit 34 including an electric motor 35 and a reduction gear box 36 and a transmission system 37 including a drive shaft 38, a worm 39 and a worm wheel 40 connecting the power unit 34 to the sling hanger 14.

The power unit 34 is mounted within a housing comprising a base 41 secured to or formed integrally with the cross member 22 and a cover 42. The depending limb 24 of the sling hanger support 13 is hollow and the drive shaft 38 is keyed at its upper end to the output of the reduction gearbox 36 and extends downwards through a hole 43 in the base 41 of the housing and through the hollow depending limb 24. The worm 39 is secured to the lower end of the drive shaft 38 for rotation therewith and is mounted in a transmission housing 44 secured to a mounting plate 45 at the lower end of the depending limb 24. The worm wheel 40 is mounted on a shaft 46 channelled for rotation in the transmission housing 44 and is in drivable engagement with the worm 39. The shaft 46 pivots the sling hanger 14 relative to the sling hanger support 13 in response to rotation of the motor 35.

Figure 3:
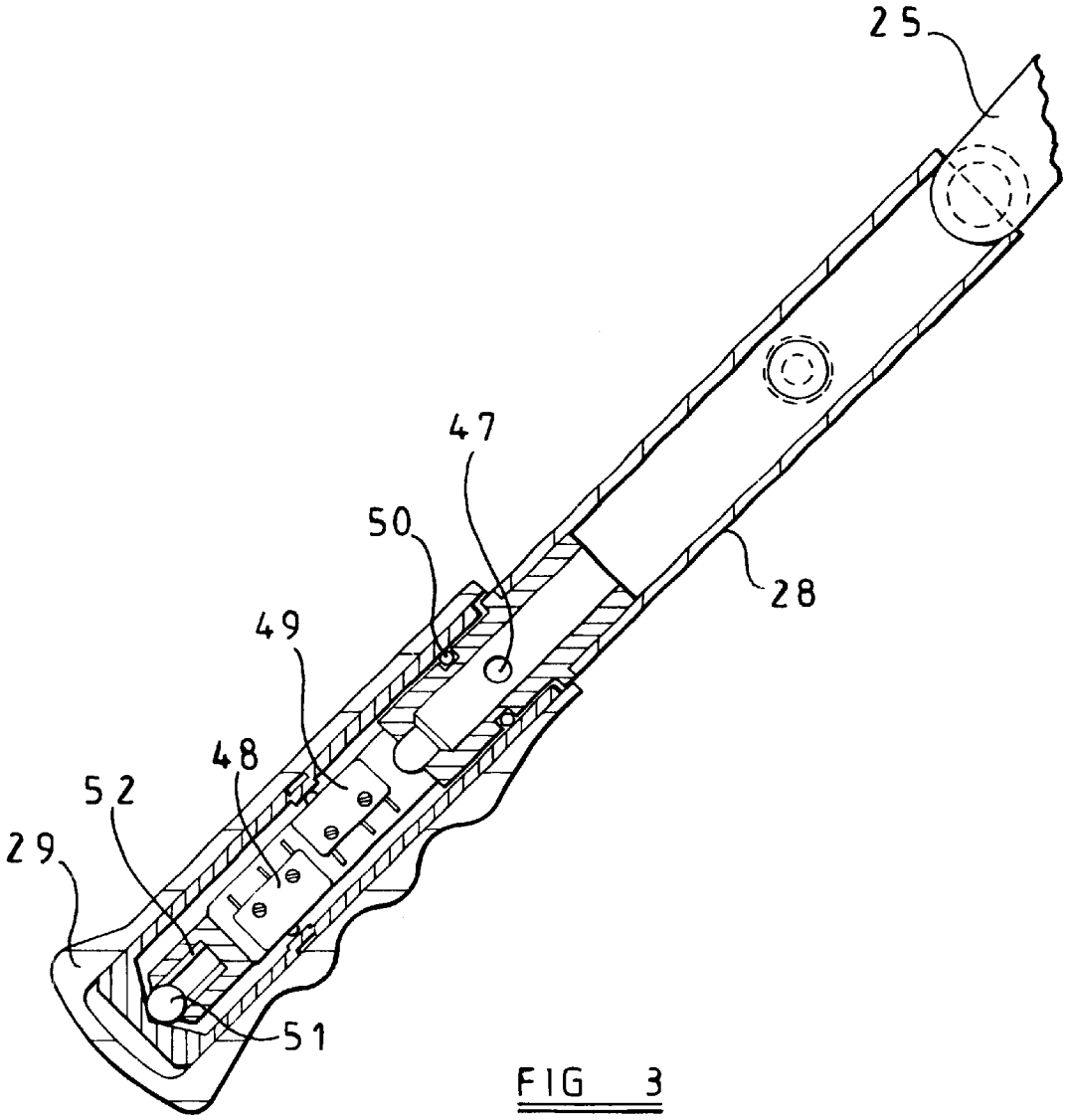
FIG. 3 is a fragmentary sectional view showing the handgrip of the sling hanger.

As best shown in FIG. 3, the hand grip 29 is mounted by a pin 47 for limited pivotable movement relative to the arm 28 and operates one of two micro-switches 48, 49 according to whether it is moved in an upwards or a downwards direction. An "O" ring seal 50 is provided between the arm 28 and the handgrip 29 adjacent to the pin 47 and a ball 51 loaded by a spring 52 is provided between the free end of the arm 28 and the inner end of the hand grip 29. The micro-switches 48 and 49 are connected to the power unit 34 through the arm 28, the limb 27 of the sling hanger 14 and the depending limb 24 of the sling hanger support 13. The power unit 34 is also connected to the rechargeable battery 9 by wiring extending through the cross member 22 and the lifting arm 12.

An attendant can pivot the sling hanger 14 by taking hold of the hand grip 29 and applying a gentle upwards or downwards force to the hand grip 29. A downwards force on the hand grip 29 will cause the hand grip to operate the micro-switch 49 to rotate the power unit 34 in a direction which will pivot the sling hanger 14 so that the arm 28 is lowered. An upwards force on the handgrip 29 will cause the hand grip to operate the other micro-switch 48 and the power unit 34 will pivot the sling hanger 14 so that the arm 28 is raised.

The rotary drive mechanism 31 thus mimics the known manually displaceable sling hanger but with no strain on the attendant.

An on/off switch 53 can be provided, such as on the arm 28, to de-energise the power unit 34 and prevent accidental operation of the rotary drive mechanism 31.

The lifting hoist described above is given by way of example only and various modifications will be apparent to persons skilled in the art without departing from the scope of the invention. For example, the sling hanger support 13 need not be supported by the free outer end of the lifting arm 12 to turn about a rigid vertical axis. It could, instead, be supported so that it can swing relative to the lifting arm.

What is claimed is:

1. An invalid hoist comprising a lifting arm, a sling hanger support angularly displaceable relative to the lifting arm about a vertical or substantially vertical axis and a sling hanger which is of unitary construction pivotable about a horizontal axis relative to the sling hanger support and which presents two spaced sling attachment points on one side of the horizontal axis and at least one sling attachment point on the other side of the horizontal axis for connection of a first pair of sling attachments to one side of the horizontal axis and for connection of a second pair of sling attachments to the other side of the horizontal axis, rotary drive means for pivoting the sling hanger about said horizontal axis relative to the sling hanger support and switch means for selectively rotating the rotary drive means in one or other of two opposite directions, wherein the sling hanger support is of inverted generally U-shaped configuration having a cross member and two parallel or substantially parallel limbs depending from the cross member, the sling hanger is pivotably connected to the lower ends of the depending limbs and the rotary drive means comprises a power unit supported by the sling hanger support at or adjacent to the cross member and a transmission system connecting the power unit to the sling hanger for pivoting the sling hanger relative to the sling hanger support.

2. An invalid hoist as claimed in claim 1, wherein the power unit includes an electric motor.

3. An invalid hoist as claimed in claim 2, wherein the power unit further includes a reduction gear box.

4. An invalid hoist as claimed in claim 1, wherein the transmission system includes a drive shaft extending within or alongside one of the depending limbs of the sling hanger support.

5. An invalid hoist as claimed in claim 4, wherein the transmission system further includes a worm and worm wheel at the lower end of the drive shaft.

6. An invalid hoist as claimed in claim 1, wherein the sling hanger is provided at one end with a hand grip which is pivotable to a limited extent in a vertical or substantially vertical plane relative to the sling hanger, the switch means being operable by pivotable movement of the hand grip in an upwards direction to cause the rotary drive means to pivot the sling hanger so that said one end of the sling hanger is raised relative to the other end and the switch means being operable by pivotable movement of the hand grip in a downwards direction to cause the rotary drive means to pivot the sling hanger so that said one end of the sling hanger is lowered relative to the other end.

7. An invalid hoist as claimed in claim 1, wherein the sling hanger comprises a generally U-shaped part, the two limbs of which are pivotably connected to the lower ends of the two limbs of the sling hanger support, respectively, and a central arm extending from the base of the generally U-shaped part away from the pivot axis between the sling hanger and sling hanger support.

8. An invalid hoist as claimed in claim 7, wherein each limb of the U-shaped part has a sling attachment at or adjacent to its free end and at least one sling attachment is provided on the central arm.

9. An invalid hoist as claimed in claim 7 when dependent on claim 6, wherein the hand grip is provided at the free end of the central arm.

10. An invalid hoist as claimed in claim 1, further comprising a chassis and a lifting column upstanding from the chassis, the lifting arm projecting from the lifting column.

* * * * *